US005850951A

United States Patent [19]

Hayes

[11] Patent Number: 5,850,951

[45] Date of Patent: Dec. 22, 1998

[54] PACKAGE WITH PUSH-PULL DISPENSING CLOSURE

[75] Inventor: Thomas H. Hayes, Loveland, Ohio

[73] Assignee: Anchor Hocking Packaging Company, Lancaster, Ohio

[21] Appl. No.: 710,741

[22] Filed: Sep. 20, 1996

Related U.S. Application Data

[60] Continuation of Ser. No. 448,797, May 24, 1995, abandoned, which is a division of Ser. No. 316,524, Sep. 30, 1994, abandoned.

[51] Int. Cl.[6] ..... B67D 3/00

[52] U.S. Cl. ..... 222/525; 220/281; 215/228; 215/295

[58] Field of Search ..... 220/724, 281, 220/282, 319, 715; 215/246, 250, 252, 216, 228, 317, 320–321, 295; 222/525, 522, 567

[56] References Cited

U.S. PATENT DOCUMENTS

| | | | |
|---|---|---|---|
| 615,453 | 12/1898 | Hipkins, Jr. . | |
| 1,418,090 | 5/1922 | Matter . | |
| 2,498,930 | 2/1950 | Wadsworth . | |
| 2,510,824 | 6/1950 | Lafarge . | |
| 2,748,974 | 6/1956 | Lafarge . | |
| 3,022,922 | 2/1962 | Pation et al. | 220/306 X |
| 3,128,004 | 4/1964 | Soffer . | |
| 3,276,642 | 10/1966 | Johnson, Jr. et al. . | |
| 3,592,349 | 7/1971 | Baugh . | |
| 3,632,006 | 1/1972 | Gilson . | |
| 3,770,153 | 11/1973 | Gach et al. . | |
| 3,828,958 | 8/1974 | Shannon . | |
| 3,841,514 | 10/1974 | Montgomery et al. . | |
| 3,860,152 | 1/1975 | Marti . | |
| 3,870,187 | 3/1975 | Bennett . | |
| 3,927,796 | 12/1975 | Whitehouse . | |
| 4,116,351 | 9/1978 | Uhlig . | |
| 4,138,028 | 2/1979 | Price et al. . | |
| 4,149,646 | 4/1979 | Julian . | |
| 4,273,247 | 6/1981 | Earls . | |
| 4,326,649 | 4/1982 | Marino et al. . | |
| 4,383,623 | 5/1983 | Page, III | 222/525 X |
| 4,473,163 | 9/1984 | Geiger . | |
| 4,535,906 | 8/1985 | Rowekamp . | |
| 4,611,723 | 9/1986 | Megowen . | |
| 4,616,759 | 10/1986 | Mahler . | |
| 4,723,671 | 2/1988 | Mears . | |
| 4,724,973 | 2/1988 | Shah . | |
| 4,749,103 | 6/1988 | Barriac | 222/525 X |
| 4,767,034 | 8/1988 | Cramer | 222/525 |
| 4,807,786 | 2/1989 | Gueret | 222/525 X |
| 4,858,758 | 8/1989 | Mitchell et al. . | |
| 4,927,065 | 5/1990 | Beck | 222/525 X |
| 4,979,648 | 12/1990 | Montgomery et al. | 222/522 X |
| 5,104,008 | 4/1992 | Crisci | 222/525 X |
| 5,238,130 | 8/1993 | Marques et al. . | |
| 5,240,131 | 8/1993 | Keller . | |
| 5,271,524 | 12/1993 | Marston | 222/525 X |

FOREIGN PATENT DOCUMENTS

| | | | |
|---|---|---|---|
| 0410922 | 1/1991 | European Pat. Off. | 222/525 |
| 1291964 | 10/1972 | United Kingdom . | |

OTHER PUBLICATIONS

Photographs of "Reddi–wip" aerosol can for whipped topping, sold by Beatrice Cheese, Inc., Waukesha, WI.

*Primary Examiner*—Gary E. Elkins
*Assistant Examiner*—Nathan Newhouse
*Attorney, Agent, or Firm*—Wood, Herron & Evans L.L.P.

[57] ABSTRACT

A package has a "push-pull" type dispensing closure either threadably engaged with or in press-fit engagement with the container mouth. The closure includes an outer skirt that is pliable and inwardly deformable when squeezed and a dispenser plug member selectively positionable to seal or unseal a dispensing orifice. The container has a mouth and a shoulder below the mouth which slants upwardly and inwardly. When the outer skirt of the closure is squeezed inwardly, the lower skirt edge engages the shoulder causing an upward camming of the closure, whereby the plug member unseals the dispensing orifice.

3 Claims, 3 Drawing Sheets

PACKAGE WITH PUSH-PULL DISPENSING CLOSURE

This application is a continuation of application Ser. No. 08/448,797, filed May 24, 1995, now abandoned, which is a division of application Ser. No. 08/316,524, filed Sep. 30, 1994, now abandoned.

FIELD OF THE INVENTION

The invention relates to a package comprising a container and a twist-off closure that is flexible, easy to grip, and easy to remove.

BACKGROUND OF THE INVENTION

Twist-off type (including threaded) closures account for roughly about 90% of all closures used on an annual basis; the number of such closures used is easily in the billions per year. The application of twist-off or threaded closures to containers requires twisting or screw threading the closure thereon, which necessitates proper initial engagement of threads or lugs, and relative rotation between the container and the closure. Twist-off closures are generally one of several varieties, including the most common, continuous thread (CT), multi-start CT with several starts on the same helical angle, or the "lug-type" closure with ramp thread segments in the form of lugs. It is not uncommon with respect to the above types of closures that users may have difficulty removing the closure by overcoming the high removal torques and in tightly resealing the closure because of the unyielding "pinch" force required. Typically, threaded or twist-off closures require knurling on the grip surface to provide enough grip to overcome the torque removal and reseal forces. Such knurling in plastic closures is oftentimes sharp and uncomfortable to the user, and it would be desirable if it could be avoided.

Thus, what has been needed is a twist-off type closure which can be easily and comfortably removed and resealed.

SUMMARY OF THE INVENTION

The subject matter of this application is related to that of my simultaneously filed applications Ser. No. 08/315,881, entitled "Press-On, Pry-Off Closure With Soft Skirt;" and Ser. No. 08/316,517, entitled "Squeeze Open Package."

In accordance with this invention, a twist-off closure is provided which is readily removed simply by gripping the closure in the hand, squeezing inwardly on a part of it and twisting the closure off the container. Because the "gripping and squeezing" action is the natural manipulation of a closure prior to opening, one's natural or mindless inclination is to grip and squeeze the closure of the invention. The unique squeezable structure of the closure of the present invention facilitates easy removal and resealing since the closure deforms to softly form fit the hand and facilitate a grip on the closure during twisting of the closure to remove it or reseal it.

In a preferred embodiment, the closure includes a plastic shell having an outer flexible skirt and an inner threaded skirt. The closure may be of the well-known composite type, thus including a plastic shell and a separately formed insert disk, or it may be of unitary, single-piece construction. The inner skirt has threads or lugs which engage a threaded container finish. In this regard, the closure may be of the CT (continuous thread), multi-start, or "lug"-type ramp thread variety. Any of these known threaded or twist-off configurations are suitable in connection with the present invention.

The outer skirt is sufficiently pliable and radially flexible that it inwardly deforms when opposing grip forces (i.e., when squeezed between the thumb and fingers) are applied to form fit the hand and provide a readily grippable closure which facilitates twist-off removal of said closure and resealing thereof. The outer skirt extends generally outwardly and downwardly around the inner skirt and preferably extends below the lower end of the inner skirt. In one embodiment, the outer skirt is preferably about twice as long (measured vertically downwardly from the rim or mouth of the container) as the inner skirt.

The pliability of the outer skirt provides a user-friendly comfortable grip on the closure which enables the user to easily grip and twist the closure off the container and enables the user to easily reseal the container. This is particularly true as compared to typical twist-off closures which have much more rigid outer walls (rigid thin metal or rigid thick plastic) that are often knurled in an effort to provide sufficient grip to overcome high removal torques, and which are substantially unyielding in terms of flexibility and thereby make tightly resealing difficult and/or uncomfortable. This is a particularly important aspect of the present invention and is valuable for the "mindless" mass of consumers that simply grip and twist a closure to remove it. Furthermore, the elderly, arthritic or otherwise encumbered may have difficulty getting a sufficiently good grip on a typical threaded or twist-off closure to remove and/or reseal it. The closures of the present invention solve these problems.

It will be appreciated that the flexible, pliable-skirt closure may take a variety of forms, including a form suitable for use on wide mouth containers. However, the relative proportions of the closure (for example, the diameter to height ratio) is not critical and the closure of the invention may be suitable for use on extra tall containers with long, relatively narrow diameter necks such as on liquor bottles, mouthwash packages, etc. It will be further appreciated that the closure of the present invention may be of a single skirt construction rather than a dual skirt construction. In this alternative, the single skirt is pliable and flexible in a radial direction and also includes internal threads adjacent its upper end so that the closure may be threaded onto a container. The lower portion of the threaded skirt provides the pliable, grippable portion.

In yet another embodiment, the invention is adapted to provide an improvement to "push-pull" type dispensing closures. In this embodiment, the dispensing orifice of the closure is unsealed by simply gripping and squeezing the outer flexible skirt which rides on a cam shoulder of the container to provide the upward force required to unseal the dispensing orifice. The closure is simply pushed down to reseal. This type of closure is generally threaded onto the container finish by means of an internal threaded member; alternatively, the closure may be in press-fit engagement with the container mouth. In this embodiment, the squeezing action provides the upward cam force that "pops" open or unseals the dispenser orifice. The outer skirt acts as a long lever and when squeezed into cammed engagement with the container shoulder applies a leveraged lifting force to unseal the central dispensing orifice. Advantageously, the outer skirt may be of uniform thickness around its circumference, so that the dispensing orifice may be unsealed by squeezing inwardly at any point around it; or the skirt may have distinct separate regions where the squeezing force must be applied in order to effectuate unsealing of the dispensing orifice.

In all embodiments of the invention, the outer skirt of the closure can be, and preferably is, sized to have substantially the same outer diameter as the sidewall of the container, below the tapered shoulder. The package thereby presents an exceptionally neat and uniform appearance in which the closure forms a visual extension of the sidewall of the container, rather than being oversized and projecting outwardly as in many twist-off type closures.

Tamper-evidencing means can be incorporated into the invention. In one embodiment, a frangible paper or shrink-on label having a line of weakness can be placed around the package, preferably covering portions of both the closure outer skirt and the container sidewall. Preferably, the line of weakness is centered over the gap between the lower edge of the closure's outer skirt and the container sidewall. Squeezing in on the closure sidewall breaks the label along the line of weakness, thereby providing readily visible evidence of opening. Furthermore, the package configuration enables use of a larger label, which facilitates compliance with new food labeling laws that effectively require large labels. In fact, using a label that extends up onto the closure, as in the present invention, may increase the available label area by 100%, for some types of packages. Thus, when the closure is gripped, but prior to twisting, the tamper evidencing provided by the frangible label provides visible evidence of opening, or attempted opening of the package.

In embodiments wherein the closure is of the composite type, the insert disk may be held on the sealed container by a vacuum force. Additionally or alternatively, the disk may be secured by an adhesive. It is preferred that the disk be able to "float" in the axial direction within the closure shell. Such float relative to the closure shell enables the shell to be moved upwardly relative to the container and disk to begin unthreading or twisting the closure off the container without lifting the disk to break the vacuum or adhesive seal at the same time. Once the closure has been partially twisted off, continued squeezing and twisting brings the threads or bead(s) above the threads on the inner skirt upwardly against the outer edge of the disk and then lifts the disk so as to break the vacuum seal.

This float between the disk and closure shell can help reduce food spoilage on store shelves if someone partially opens the package to sniff or taste the contents. The reason for this is that the perforated label is broken by initial squeezing and/or twisting of the closure, but the container seal itself is not immediately broken. Many "sniffers and tasters" will be deterred from further efforts once they see that the label has been broken, and will return the package to the shelf where it may sit for some time. Because the package seal has not been broken, the shelf life of the product is not diminished by this type of partial opening.

DESCRIPTION OF THE DRAWINGS

The invention can best be further described by reference to the accompanying drawings, in which.

DETAILED DESCRIPTION OF THE INVENTION

Figure 1:
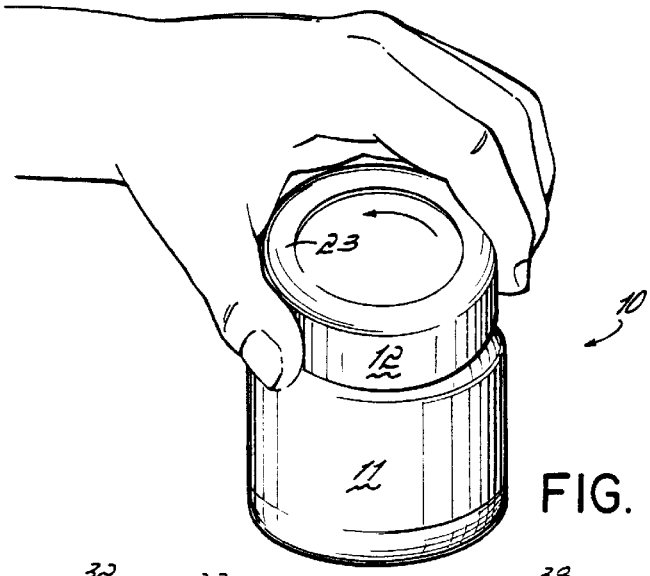
FIG. 1 is a perspective view showing the package in accordance with a preferred embodiment of the invention, being opened by squeezing and twisting the closure.
Figure 2:
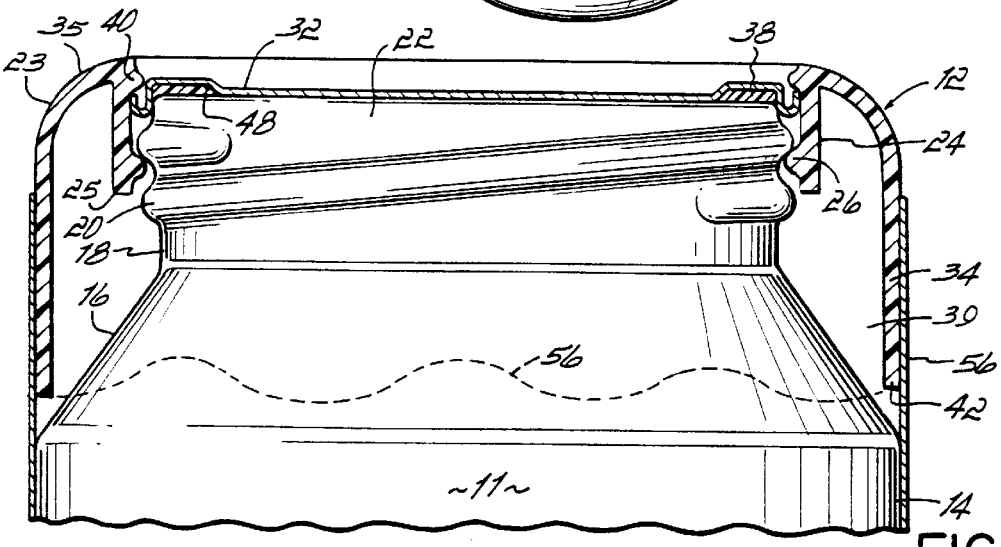
FIG. 2 is an enlarged partial axial section of a sealed package in accordance with a preferred embodiment of the invention, prior to squeezing and twisting the closure to remove it.
Figure 3:
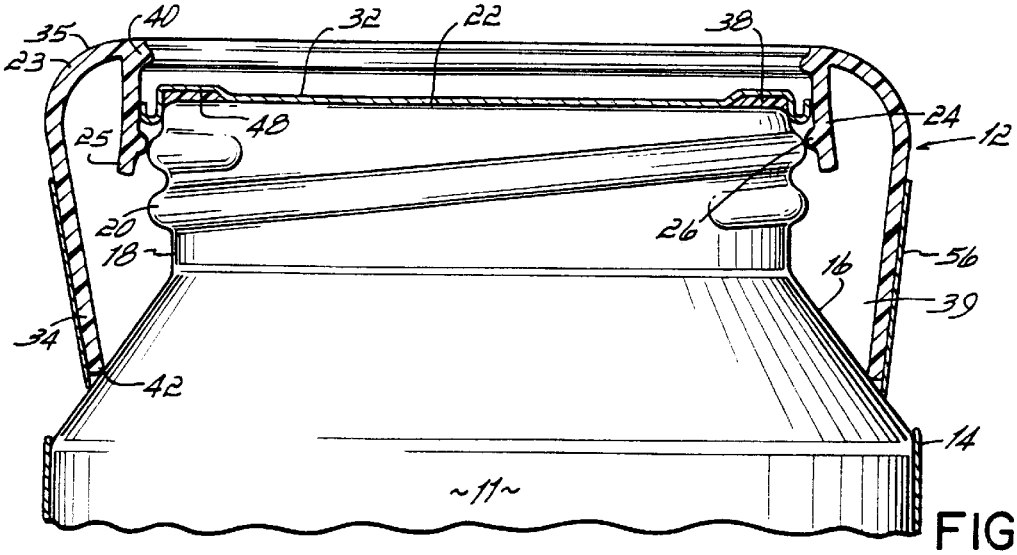
FIG. 3 is a sectional view similar to FIG. 2 but with the closure shown in a squeezed position.

A first embodiment of the invention, shown in FIGS. 1–3, comprises a package 10 which includes a container 11 and a easy-to-grip, flexible squeeze closure 12 threaded on container 11. In principle, container 11 can be glass or plastic or even a metal container like a "tin" can, and can take a wide variety of configurations other than the cylindrical configuration shown.

In a preferred form, container 11 has a circular, right cylindrical sidewall portion 14 which leads upwardly to an inwardly slanting shoulder 16. Shoulder 16 is preferably a frustoconical surface, as shown in FIGS. 2 and 3, or it may curve upwardly with progressively increasing steepness. Above shoulder 16, container finish 18 includes threads 20 around container mouth 22. Although shown with common continuous threads (CT), it will be appreciated that multi-start threading or lug-type ramp threads can be utilized and that the invention is not limited to the specific type of thread structure on the container. As will be described, closure 12 has a threaded, downwardly-depending skirt 24 with internal threads 26 which engage threads 20 on container finish 18. Thus, closure 12 is a true twist-off or threaded closure.

Closure 12 is preferably a composite-type closure comprising a plastic shell 23 which houses a separately formed, non-integral disk 32. However, it should be understood that the invention is not to be construed as limited to composite-type closures. Although not explicitly shown, an alternative embodiment contemplates a closure similar in all respects to that shown in FIGS. 2 and 3, except that the disk portion 32 is integral with and forms a part of a single-piece closure.

In the embodiment shown in FIGS. 1–3, closure shell 23 is double-walled; i.e., it has an inner threaded skirt 24 which houses the insert disk 32, and a larger diameter and longer outer skirt 34. The outer skirt 34 meets and joins inner skirt 24 at the top 35 of the closure, and surrounds and extends downwardly beyond the top. Inner skirt 24 is preferably relatively short; it extends downwardly from the top, and includes threads 26 for threaded engagement with threads 20 on container finish 18. Preferably, outer skirt 34 extends downwardly substantially beyond the plane of the lower terminal end 25 of inner skirt 24. The longer length of the outer skirt provides an advantageous function, which is to capture or retain steam in the head space 39 during the closure application process. This is believed to result in more efficient steam sweeping, which in turn may result in higher vacuum seal of the container and longer shelf life.

It is further preferable that outer skirt 34 join inner skirt 24 above the plane of insert disk 32. This reduces the possibility of abuse from warehouse stack load, facilitates nesting of containers for shelf stacking, and saves material. Alternatively, however, it is contemplated that the outer skirt can join the inner skirt below the disk, although the resulting package is not so visually unique and may not be as effective.

Outer skirt 34 is of thin-wall construction such that it is sufficiently pliable to the extent that the opposing grip forces between the thumb and fingers of a user causes it to deform inwardly around these pinch points and softly, form fit the hand to enhance the user's grip on the closure and ease closure removal and resealing. With this construction, there is no need for the typical knurling that is used on many twist-off closures to overcome high removal torques or the forces necessary to effectuate resealing.

In the embodiment shown in FIGS. 1–3, the insert disk 32 is a top loaded disk; i.e., it is inserted into shell 23 from the top, into the inner skirt past the disk retaining lip 40. Bottom load disks can also be used in connection with the closures of the present invention. The disk 32 may be made of metal, cellulosic material, or plastic. Usually it will have a gasket or sealant material 48 in a peripheral groove, which forms a top and/or side seal with the inner and outer sides and/or top of the container rim 38. The disk 32 may be held on the container rim 38 by a vacuum, i.e., greater outside pressure force than the inside pressure force, and/or by an adhesive (not shown) on the rim 38. The disk 32 shown is of the preferred, floating disk type; i.e., is axially movable within shell 23. Disk 32 is retained by, and is movable between thread 26 and lip 40 at the top of the inner skirt 24. As will be seen, this disk "float" is highly desirable because it enables the disk lifting, vacuum breaking step of the closure removal operation to occur separately from and subsequent to the unthreading step and/or the breaking of tamper evidencing connectors.

Shell 23 is elastically deformable and pliable and is preferably molded of a polyolefin such as polypropylene. The outer skirt 34 is also preferably thinner and more flexible than the inner skirt 24. In this embodiment, as shown in FIGS. 1–3, the outer skirt must be sufficiently flexible that it can be squeezed between the thumb and fingers of the hand (FIG. 1), to press it inwardly (FIG. 3). When the outer skirt is squeezed, it deforms and form fits the hand to provide excellent gripping of the closure which facilitates easier twist-off action and removal of the closure. Preferably, outer skirt 34 is relatively thin so as to reduce material costs and to reduce the resistance to squeezing. It has been found that suitable outer wall thicknesses in the range of 0.012" to 0.045" depending on diameter and height ratios provide sufficient pliability to achieve the advantageous results of the present invention. However, this thin wall structure is susceptible to distortion during various stages of packaging and processing, such as retorting. This deformation can be corrected when the package label is applied, as described below, by restoring the circular integrity of the skirt.

In use, outer skirt 34 is inwardly deformed by a squeezing action and the container is readily unthreaded or twisted off container finish 18 due to the improved grip on the closure. As closure shell 23 travels in an upward direction due to the unthreading, it will subsequently engage and lift disk 32 off of the container mouth 22, thus breaking the seal and opening the package. As shown in FIG. 2, the lower edge 42 of outer skirt 34 is preferably spaced slightly upwardly, for example about 1/16", from container shoulder 16 (measured perpendicularly from the container shoulder). This gap or spacing allows spray washing and drainage of food residue after filling and retorting the package 10.

This invention is adaptable for use with tamper evidencing means. FIGS. 2 and 3 show a tamper evidencing means in the form of a paper band or plastic shrink band 56, which tightly encircles the package 10, extending downwardly beyond the lower edge 42 of the outer skirt and onto the container sidewall. The outside configuration or diameter of the outer skirt 34 preferably substantially matches the outside diameter of the container sidewall below the shoulder 16. As seen in FIGS. 1 and 2, the closure outer skirt then appears to be an extension of the line of the container sidewall, in contrast to many twist-off closures in which the closure is often larger in diameter than the container sidewall.

The shrink band or paper label 56 has a line of weakness 58 that forms a series of straight or undulating perforations which break readily when the outer skirt 34 is squeezed (see FIG. 3). These perforations are preferably centered over the gap between the skirt and shoulder. Squeezing the outer skirt at opposite points breaks the perforations at those points; at right angles to the squeeze points, "ovalizing" of the closure breaks the band by outward movement of the closure. The opening or attempted opening of the package is thereby readily displayed. It is particularly advantageous if the line of weakness is in the form of a vertically offset line, as shown in FIG. 2. Then, the natural tendency to twist the closure causes the peaks and valleys of the offsets to rub against one another, thereby deforming them and making the opening or attempted opening even more readily visible.

As mentioned above, because outer skirt 34 is relatively thin and flexible, it may not be perfectly symmetrical around its circumference and may initially be somewhat oval rather than circular in section. An advantage of providing a label which overlaps both the outer skirt and the container sidewall is that, if applied tautly (under slight tension), it tends to "circularize" an outer skirt which is not already circular and brings it into a much more nearly circular configuration. This provides a cleaner, more regular appearance to the package.

Alternatively, other tamper evidencing means (not shown) can be used such as a tear band with integral bridges. The band may lock beneath a container rib; it may drop and remain on the container or a tear tab may be discarded.

Figure 4:
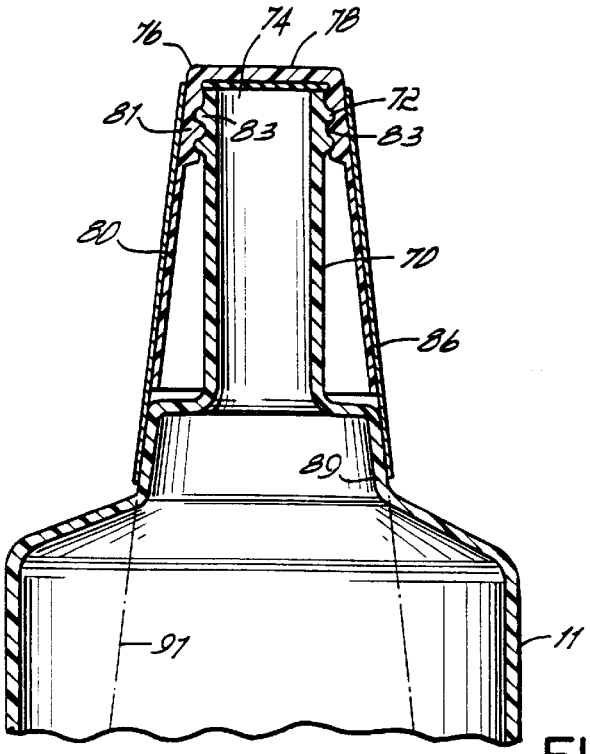
FIG. 4 is an enlarged partial axial section of a sealed package in accordance with a second embodiment of the invention.

Whereas a preferred embodiment of the invention as described hereinabove includes a composite closure having a double-skirted shell in combination with a relatively wide-mouthed jar or container, the invention can also be used in a single-skirt embodiment as shown in FIG. 4. This embodiment may be particularly useful with containers having taller necks or neck finishes of relatively narrow diameter, such as are commonly found in liquor bottles, mouthwash containers, etc.

In the embodiment shown in FIG. 4, the container 11 has a relatively tall, small diameter neck 70 with threads 72 at its upper extremity adjacent mouth opening 74. Closure 76 has a top wall section 78 and a downwardly depending skirt 80 which is relatively thick at its upper end 81 adjacent closure top 78. As shown, upper skirt section 81 has internal threads 83 which engage external threads 72 on container finish 70. Skirt 80 is of thin-wall construction below the threaded upper section 81 so that it is pliable and readily squeezed by a user to provide the form-fit gripping action described hereinabove with respect to the closure of FIGS. 1–3. It will be appreciated that closure 76 is preferably configured to provide a sleek profile that forms a visual extension of container 11 sidewall 89 or 91 (phantom).

Also, as described hereinabove, a tamper evidencing paper label or plastic band 86 may be applied about the closure and extends downwardly beyond the lower edge of flexible skirt 80 and onto container sidewall 89.

It will be appreciated that in connection with either of the above embodiments, a separate foil or other freshness seal, beneath the top and adhered directly to the container rim, may be used to seal the container mouth; the top or disk of the closure need not necessarily provide the seal.

Yet another feature which may be incorporated in the closures of the present invention are "child-proof" structures. A variety of suitable childproof structures are known in the art and can be utilized in connection with the present invention.

Figure 6:
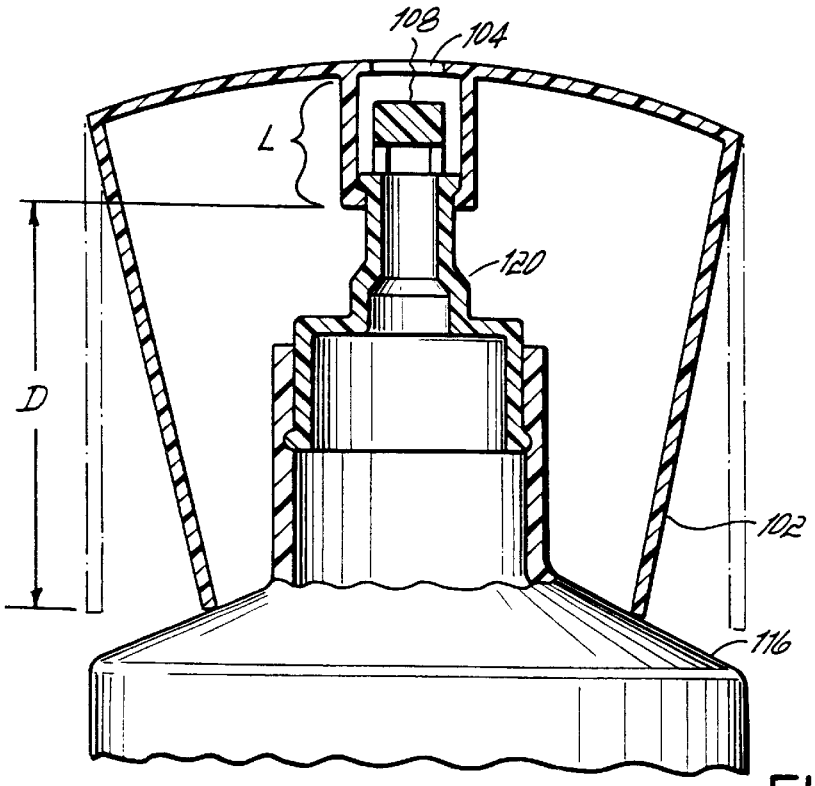
FIG. 6 is a sectional view similar to FIG. 5B showing an alternative closure structure in a squeezed position with an unsealed dispensing orifice.
Figure 5A:
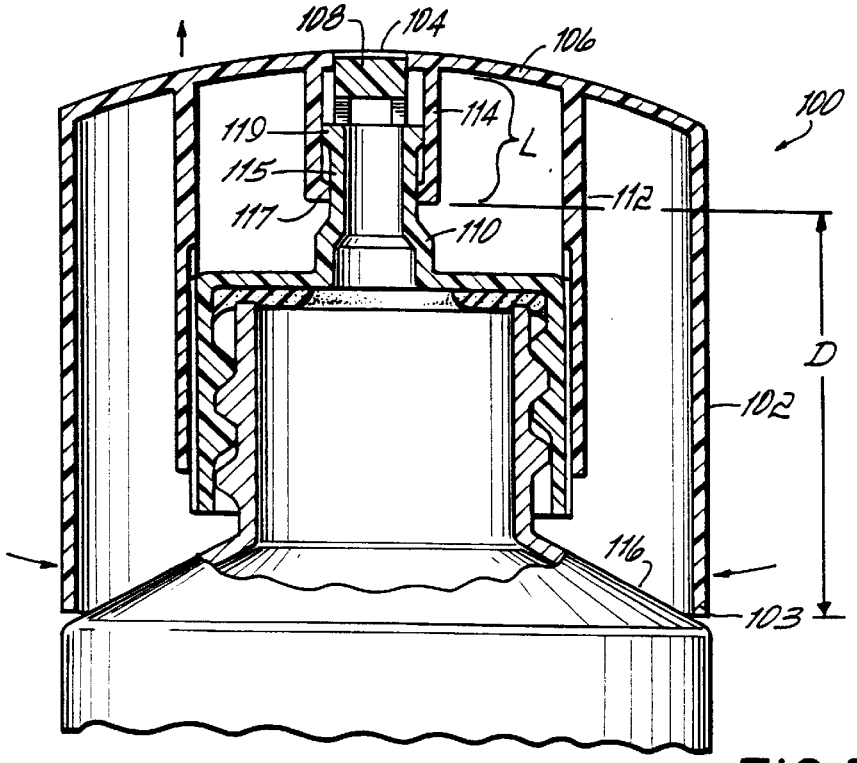
FIG. 5A is an enlarged partial axial section of a sealed package in accordance with a third embodiment of the invention, prior to squeezing the closure to unseal a dispensing orifice.
Figure 5B:
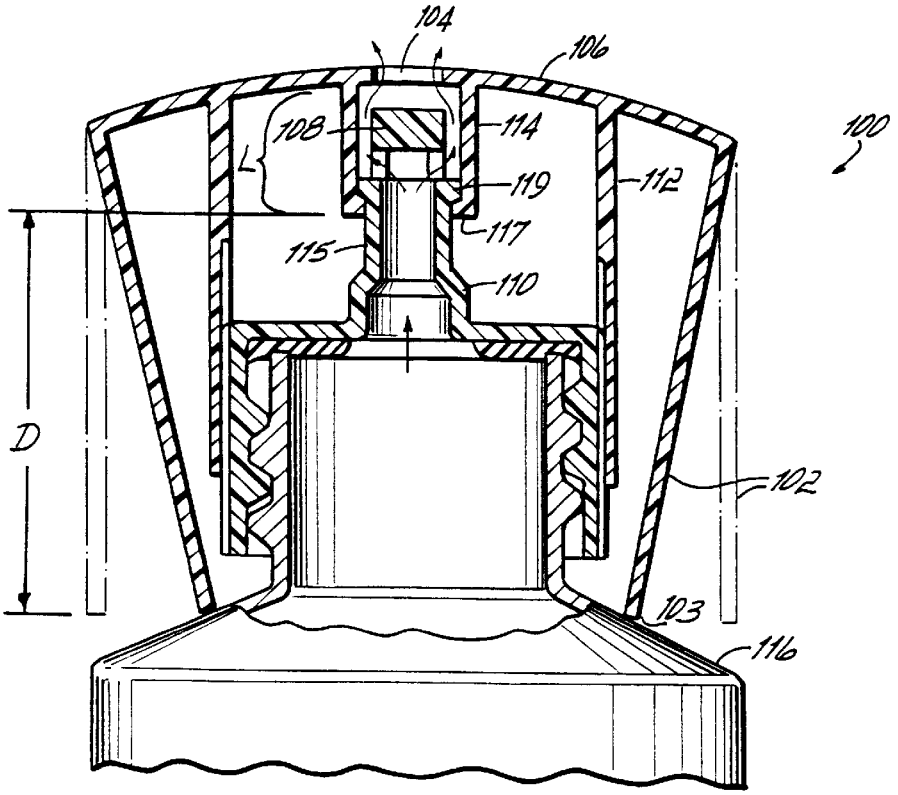
FIG. 5B is a sectional view similar to FIG. 5A but with the closure shown in a squeezed position with the dispensing orifice unsealed.

FIGS. 5A, 5B and 6 show another application of the closure of the present invention in connection with a "push-pull"-type dispenser closure. Generally in this type of dispenser closure an outer or upper portion of the closure is pulled upwardly to unseal a central dispensing orifice and is then pushed downwardly to reseal the orifice. Utilizing a flexible outer skirt 102 of closure 100, the upward force required to unseal central dispensing orifice 104 in the present invention is provided by the cam lifting action generated as flexible skirt 102 is squeezed inwardly and rides up on angled container shoulder 116. In other words, as the user grips and squeezes inwardly on the skirt 102, the lower edge 103 thereof bears against and is cammed upwardly on container shoulder 116. The cam engagement of lower edge 103 of outer skirt 102 with shoulder 116 exerts an upward force transmitted through the outer skirt 102 to lift the closure top 106 (through which dispensing orifice 104 passes), so as to unseal the orifice 104 relative to orifice plug member 108, to provide a flow path for the contents of the container as shown in FIGS. 5A and 5B. With this embodiment, the container can be opened using only one hand since the squeezing action provides the unsealing action and the user need not grip the container to hold it in place while the closure is lifted.

In the construction shown in FIGS. 5A and 5B, the dispensing orifice plug member 108 is integral with a threaded member 110 that is threaded on the container finish and is exemplary of a construction well known in the art. In that configuration, an intermediate skirt 112 is provided which frictionally engages threaded member 110 so as to facilitate application of the entire closure onto the container finish by thread-on action. An inner skirt 114 is provided which surrounds dispensing orifice 104. This inner skirt 114 engages upstanding section 115 of threaded member 110; these two components have limited relative movement due to the presence of respective beads 117, 119 (or lugs) which prevent complete disengagement of the closure top 106 and the threaded plug member 110. As shown, inner skirt 114 has a length L and outer skirt's lower edge 103 is spaced downwardly a distance D below the inner skirt's lower edge. The distance D is greater than the length L. The interengagement between intermediate skirt 112 and the threaded member 110 facilitates removal of the entire closure 100 (including threaded member 110) by threading it off of the container, so the container can be refilled.

In the alternative structure shown in FIG. 6, the plug member is integral with a press fit member 120 that is press fit on the inside of the container finish. This construction obviates the need for an intermediate skirt. In all other respects, this structure operates in the same manner as that described and shown in FIGS. 5A and 5B; i.e., inward squeezing of the flexible outer skirt 102 provides a cam lifting action force which unseals the dispensing orifice 104. Also, as described above, length L of the inner skirt is less than the distance D, which is the distance the outer skirt's lower edge is spaced downwardly below the inner skirt's lower edge.

An alternative structure (not explicitly shown) that is related to those shown in FIGS. 5A, 5B and 6 is also contemplated. In this alternative, the container is biaxially asymetrical in cross-section; i.e., one axis is longer than a perpendicular axis, such as an oval for example. The closure would also be non-symmetrical such that as a twisting and squeezing force is applied, the closure would ride or cam up on the container shoulder, thus providing the requisite lift required to unseal the dispensing orifice.

It will be appreciated that the invention is not to be limited to the specific details and example embodiments described herein. Various changes and modifications to the structure of the present invention will become apparent to persons skilled in the art, and thus the scope of the invention is defined by the appended claims.

Having described the invention, what is claimed is:

1. A product package comprising a container and a dispenser closure therefor, said dispenser closure comprising a closure shell which has a top having a dispensing orifice therethrough, an outer skirt joining said top and extending downwardly therefrom to a free lower edge, and an inner skirt joining said top and extending downwardly to a lower edge, said outer skirt's free lower edge spaced downwardly below said inner skirt's lower edge, said closure further comprising a dispenser plug member which is snap-engaged and held captive within the inner skirt of said shell but in relation to which the shell is movable upwardly and downwardly through a limited range of movement to respectively seal and unseal said dispensing orifice, said container having a mouth which receives said dispenser plug member, and a shoulder below said mouth which slants upwardly and inwardly, said skirt being pliable and inwardly deformable about its entire circumference by squeezing it with the fingers at any diametrically opposite portions of the lower edge of said skirt to bring said portions into engagement with said shoulder on said container, such squeezing causing said shoulder to cam said closure top upwardly relative to said plug member to thereby unseal said dispensing orifice.

2. The package of claim 1 wherein said container further comprises external threads adjacent said mouth, and said dispenser member is threaded and configured to engage said threads on said container to maintain said closure on said container during sealing and unsealing operations.

3. The package of claim 1 wherein said dispenser plug member is in press-fit engagement with said container mouth to maintain said closure on said container during sealing and unsealing operations.

* * * * *